US006588240B2

(12) United States Patent
Anderson

(10) Patent No.: US 6,588,240 B2
(45) Date of Patent: Jul. 8, 2003

(54) HINGE LOCK SAFETY CUFF

(76) Inventor: Brent L. Anderson, Rte. 1, Box 158, Yoder, WY (US) 82244

( * ) Notice: Subject to any disclaimer, the term of this patent is extended or adjusted under 35 U.S.C. 154(b) by 0 days.

(21) Appl. No.: 09/883,652

(22) Filed: Jun. 18, 2001

(65) Prior Publication Data

US 2002/0189302 A1 Dec. 19, 2002

(51) Int. Cl.[7] ..... E05B 75/00
(52) U.S. Cl. ..... 70/16; 70/15; 70/17; 16/327
(58) Field of Search ..... 70/15, 16, 17; 16/230, 252, 319, 327

(56) References Cited

U.S. PATENT DOCUMENTS

| | | | | | |
|---|---|---|---|---|---|
| 1,157,135 | A | | 10/1915 | Wesson et al. | |
| 1,872,857 | A | | 8/1932 | Wesson et al. | |
| 2,966,787 | A | * | 1/1961 | Tompkins | 70/16 |
| 3,618,345 | A | * | 11/1971 | Smith | 70/16 |
| 4,138,867 | A | * | 2/1979 | Tompkins | 70/16 |
| 4,287,731 | A | | 9/1981 | Kruger | |
| 4,300,368 | A | * | 11/1981 | Sullivan | 70/16 |
| 4,314,466 | A | | 2/1982 | Harris | |
| 4,697,441 | A | * | 10/1987 | Allen | 70/14 |
| 4,840,048 | A | | 6/1989 | Elam | |
| 5,138,852 | A | | 8/1992 | Corcoran | |
| 5,205,142 | A | | 4/1993 | Kruger et al. | |
| 5,461,890 | A | * | 10/1995 | LeFavor | 70/16 |
| 5,485,655 | A | * | 1/1996 | Wang | 16/371 |
| 5,598,723 | A | * | 2/1997 | Ecker et al. | 16/223 |
| 5,687,593 | A | | 11/1997 | Cross | |
| 5,697,231 | A | * | 12/1997 | Tobin, Jr. | 403/56 |

OTHER PUBLICATIONS

Galls Catalog, Fall 2000, pp. 2, 166, 167.

An extensive historical array of handcuffs is available on the internet at the present address www.blacksteel.com, divided into nine separate sections relating to handcuffs. The following are drawing of copies obtained Aug. 30, 2000:.

Smith & Wesson 300 Handcuffs (hinged) Securitech Pivot Handcuffs (from "Allen's collection").

South–African Hinged Handcuffs Trilok HG–1001 Hinged Handcuffs.

Unknown Rigid Handcuffs YUIL MO3 HS Handcuffs Peerless Hinged Handcuffs.

Ralkem 9922 Hinged Handcuffs (Czechoslovakia) Republic HG Handcuffs Russian Hinged Handcuffs.

Russian New Hinged Handcuffs Martin Rigid Handcuffs—five models Horst–Moabit Pivot Handcuffs.

Lips Handcuffs Hiatt Hinged Handcuffs Hiatt Darby 115–N Bar Handcuffs.

Deutsche–Polezei Handcuffs Dutch Hinged Handcuffs Fury 15914 Handcuffs Gill Flash Handcuffs.

Hamburg 8 Handcuffs Blueline Hinged Handcuffs Clejuso Hinged Handcuffs American Handcuff N–400.

Hiatt UL–1 Handcuffs.

Peerless Handcuff Company CDS QuikKuf Rigid Handcuffs.

American Handcuff N–500, 520, 550 and A–550.

* cited by examiner

*Primary Examiner*—Anthony Knight
*Assistant Examiner*—Christopher Boswell
(74) *Attorney, Agent, or Firm*—James K. Poole, Esq.

(57) ABSTRACT

Folding handcuffs include a lockable hinge which permits folding the assembly for compact storage but automatically locks into a rigid assembly when fully unfolded. The hinge operates by the movement of a locking bar into locking groove(s) via a tensioning mechanism when the hinge components are aligned in the unfolded, extended configuration. The lockable hinges can also be used to connect the components of a variety of common tools including shovels, saws and the like.

23 Claims, 4 Drawing Sheets

HINGE LOCK SAFETY CUFF

BACKGROUND OF THE INVENTION

1. Field of the Invention

The present invention relates generally to handcuffs for restraining prisoners or the like, and particularly to handcuffs which can be folded for storage or carrying via hinges but form a rigid structure when unfolded for use.

2. Description of Relevant Art

Handcuffs and other mechanical restraints have been used to restrict the activities of prisoners for hundreds of years. Many conventional handcuffs take the form of lockable cuffs linked by chains, other flexible connectors or by fixed, "rigid" connections such as a solid piece of steel. Many designs have been employed for various purposes and situations ranging from the arrest and restraint of suspects to long term confinement, transportation and court appearances. Different designs have attempted to provide improvements in such areas as ease of carrying by law enforcement officers, compact storage, ease of applying and locking the cuffs on a suspect during arrest, and security once applied and locked. In some cases, making handcuffs easier to carry, apply and lock have made them less secure; conversely, providing double and triple locking mechanisms may make the cuffs more complicated and more difficult to apply and lock on a struggling suspect. Hinged handcuffs have been produced which fold along a central hinge for carrying or storage, then open for application to the prisoner. Such hinged cuffs allow less freedom of movement for a cuffed subject, and in some cases the hinge can be locked open to provide a rigid structure. Such an arrangement can be useful when a law enforcement officer has applied a handcuff bracelet member to a suspect's wrist, as the rigid linking structure provides a convenient means for guiding the suspect or even enforcing the officer's will upon the suspect through uncomfortable pressure on the nerves in the wrist. Such rigid handcuffs and methods for their use are disclosed in U.S. Pat. No. 4,840,048, which is incorporated herein by reference.

Rigid handcuff designs offer better control over a struggling or resisting suspect, as they offer superior leverage with which to control the suspect and take him under control. However, a major shortcoming of "fixed" rigid handcuffs (such as disclosed in U.S. Pat. No. 4,840,048) is their storability. Such types of rigid handcuffs cannot be compactly stored on an officer's belt and often require a special carrying case.

Non-rigid handcuffs, commonly connected by flexible members such as chains or hinges, offer the benefit of occupying much less space when in their folded positions. However, they are not as easy to use or to apply to persons being restrained as is a rigid handcuff. Examples of non-rigid handcuffs are disclosed in U.S. Pat. Nos. 5,205,142; 5,138,852; 1,157,135 and 1,872,857.

U.S. Pat. No. 5,687,593 (to Hiatt & Co.) discloses a handcuff with the advantage of being able to assume a folded position, yet forming a rigid assembly when opened for use. A shortcoming of this invention is that even though it occupies less space than a fixed rigid handcuff by its ability to fold, it is still much bulkier than a common non-rigid handcuff and requires a special (larger) handcuff carrying case. The hinging and locking assembly is bulky and mechanically complex.

An extensive historical array of handcuffs is available on the Internet at the present address www.blacksteel.com, divided into nine separate sections relating to handcuffs. Although most are undated, many are clearly ancient history. Applicant is unaware whether similar information has been published elsewhere. Some pertinent examples, drawings of which have been deposited with the present application, from copies obtained Aug. 30, 2000, include:

Smith & Wesson 300 Handcuffs (hinged)

Securitech Pivot Handcuffs (from "Allen's collection")—described as regular Peerless handcuffs to which a bar has been welded in place of the chain.

South-African Hinged Handcuffs

Trilok HG-1001 Hinged Handcuffs

Unknown Rigid Handcuffs—Made from two cuffs with chain swivels and chain replaced by a single heavy piece of steel.

YUIL M03 HS Handcuffs—two conventional cuffs joined by a rigid center section.

Peerless Hinged Handcuffs

Ralkem 9922 Hinged Handcuffs (Czechoslovakia)

Republic HG Handcuffs

Russian Hinged Handcuffs

Russian New Hinged Handcuffs—"official handcuffs of the Russian Police"

Martin Rigid Handcuffs—five models, "Rigid Bent", Rigid E, "Rigid", Rigid S and Rigid XL, all individually made by a German machinist Martin. Various arrangements of conventional cuffs separated by rigid sections of various shapes and sizes.

Horst-Moabit Pivot Handcuffs

Lips Handcuffs (hinged cuffs made by Dutch company)

Hiatt Hinged handcuffs, models 2050, 2060, 3000 and 4075

Hiatt Darby 115-N Bar Handcuffs—Darby ratchet style cuffs attached by rings to a metal bar.

Deutsche-Polezei Handcuffs—three models of hinged handcuffs, including models HS and WW-II, from former East German Republic.

Dutch Hinged Handcuffs

Fury 15914 Handcuffs—hinged handcuffs made in Spain, "from Adam's collection".

Gill Flash Handcuffs—cuffs joined by a solid metal section, from Gill Co. of Kansas City.

Hamburg 8 Handcuffs—"an escape cuff from yesteryear" with hinged construction which allows cuffs to be opened when the mechanism is folded. When the mechanism is fully extended and the bows are pressed clown, they lock.

Blueline Hinged Handcuffs

Clejuso Hinged Handcuffs

American Handcuff N-400—hinged handcuff with cuffs joined by three ball-ended pins which serve as the hinge. Similar American models N-500, 520 and 550 plus A-550 (aluminum) join the cuffs by three pivot-anchored bars which serve as the hinge. American Handcuff Company is a fully owned division of Tobin Tool & Die Co., located in Fond du Lac, Wis.

Hiatt UL-1 handcuffs—"the Ultimate". "Stored in officer's handcuff case folded like regular hinged cuffs, but once opened, lock into that position. Same key used to unlock cuffs and center rigidifying mechanism." Apparently disclosed in U.S. Pat. No. 5,687,593, which illustrates a connecting member 12 comparable in size to the bracelet members and containing a catch member 29 which can engage with each bracelet member to hold them in an extended position to form a rigid handcuff.

Peerless Handcuff Company of Springfield, Mass. manufactures a hinged handcuff model 301 (viewed Aug. 30, 2000 at www.peerless.net). Peerless also produces the industry standard swing-through cuff.

CDS QuikKuf Rigid Handcuffs

A Gall's catalog (Lexington, Ky.) dated January, 2001 (see also www.galls.com) lists the following hinged cuffs:

Smith & Wesson Hinged Handcuffs (D), page 167 American Ultra Lite and Oversized Hinged Handcuffs (3,4,5), page 167

Hiatts Ultimate Hinged Handcuffs (D), page 166—"rigid when drawn and fold after use"

Peerless Hinged Handcuffs (4, 5), page 166.

Many types of handcuffs and other restraints have been patented over the years, and patent activity continues vigorous to the present day, as the need persists for secure but humane restraint of suspects, prisoners and the like.

U.S. Pat. No. 4,314,466 discloses triple-locking handcuffs in which the cuffs are interconnected by conventional chains.

U.S. Pat. No. 4,138,867 discloses hinged handcuffs and lock, a set of handcuffs having two wings connected by a hinge, wherein the hinge sections are formed directly on the wing section walls and the handcuff locking mechanism operates as a hinge pin to hold the wing sections together, and also as a locking device. FIG. 11 illustrates the relationship of the hinge rings.

Kruger's U.S. Pat. No. 5,205,142 discloses hinged handcuffs. Kruger's U.S. Pat. No. 4,287,731 discloses an improved double lock assembly which can be used on handcuffs such as those of his '142 patent.

Despite all the development and testing of these relatively "low-tech" mechanical devices, improvements are still sought to obtain a better balance between convenience and ease of application and security. In particular, improvements are needed in hinged handcuffs which can be locked in an open position to provide a rigid structure for restraining prisoners, yet fold completely for storage.

SUMMARY OF THE INVENTION

It is thus an object of the present invention to provide handcuffs which can be easily folded for convenient storage and carrying. Another object of the invention is to provide hinged handcuffs which can be folded for storage and locked in an open, extended position for use on a suspect. A further object is to provide handcuffs which can form a rigid structure when locked in the open position. Still another object of the invention is to provide hinged handcuffs which can be easily and quickly applied to a suspect and locked in place to provide secure restraints. In summary, the broad object of the present invention is to provide a handcuff which occupies the same (or less) space as a non-rigid handcuff when in the folded (storage) position, but is made rigid when opened for use. Another object is to provide a foldable rigid handcuff which can be carried in a standard size handcuff case. A further object is to offer novel means of rigidifying a foldable hinge by mechanisms disclosed herein.

In accordance with the present invention, a lockable hinge is provided which comprises two hinge assembly components, each comprising a hinge platform and at least one hinge paw attached thereto (at opposite ends), each hinge paw forming a cylindrical opening which is rotationally attached to the center hinge rod so that the hinge paws are adjacent, preferably intertwined like the fingers of clasped hands, and can rotate in opposite directions on the rod. Retaining means are provided to keep the hinge assembly components in position, with the cylindrical openings of the hinge paws rotationally attached to the hinge rod, and mechanical means are provided for automatically locking the hinge paws to the center hinge rod when the hinge components are rotated to the fully opened position, normally forming a single plane. A first hinge assembly component should contain at least one hinge paw and the second hinge assembly component should contain at least one more hinge paw than the first, so that when the hinge paws intertwine when they are rotationally attached to the hinge rod. One set of the hinge paws can be mechanically attached to the center hinge rod to prevent it from rotation about the rod and retain the intertwined hinge paws in place. For example, a mechanical fastener can be installed to extend laterally through at least one hinge paw and the hinge rod passing through its cylindrical opening. Alternatively, at least one hinge paw can be mechanically attached to the hinge rod by at least one projection from the side of the hinge rod which interacts with at least one longitudinal groove in the inner cylinder wall of the cylindrical opening in the hinge paw.

Means are provided for unlocking the hinge paws when the hinge is locked, thus allowing the hinge assembly components to rotate and fold the hinge. The hinge paws can be locked to the center hinge rod (to lock the hinge) by providing at least one longitudinal locking groove within the inner cylinder walls of each hinge paw, positioned such that all the grooves are in alignment when the hinge is in fully extended position (normally defined by the hinge assembly components forming a single plane), and a locking bar which is adapted to enter all of the grooves when aligned to lock them into position upon the center hinge rod. The locking bar is positioned in a longitudinal recess upon the surface of the center hinge rod, and is fitted with tensioning means to press the locking bar outward so that a portion of it enters the locking grooves when they reach alignment, with a portion of the locking bar remaining within the longitudinal recess to lock the hinge paws to the hinge rod. The tensioning means can be suitable springs (coil, leaf, etc.) Installed under the locking bar. External access means such as a hole, rod or button are provided for exerting inward pressure upon the locking rod to force it from the locking grooves and back into its longitudinal recess to unlock the hinge paws and allow rotation of both paws and hinge assembly components.

The lockable hinges described above have many useful applications for use as components of tools and the like. Useful folding, lockable handcuffs can be assembled by joining two conventional handcuff wrist bracelets to the hinge platforms of two hinge assembly components of a lockable hinge as described above. The bracelets can be separately opened and locked when closed, and the hinge automatically locks when fully opened, forming a rigid handcuff assembly.

Additional objects and advantages of the present invention are described in, and will be apparent from, the following detailed description of certain preferred embodiments, together with the drawings and appended claims.

DETAILED DESCRIPTION OF PREFERRED EMBODIMENTS

It should be understood that the following description of some presently preferred embodiments of the present invention is merely representative of many possible embodiments and thus is not intended to limit the scope of the present invention. In the following description, like structures will be referred to by similar numerical designations. In some figures, some features may be omitted to clarify the illustration of the remaining features.

Figure 1:
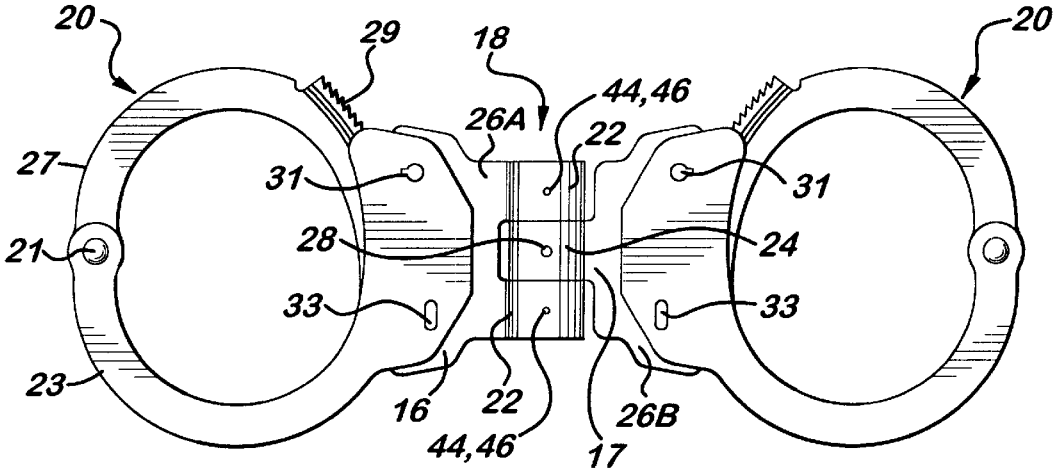
FIG. 1 is a top view of the Hinge Lock Safety Cuff (HLSC) in the locked opened (or rigid) position.
Figure 2:
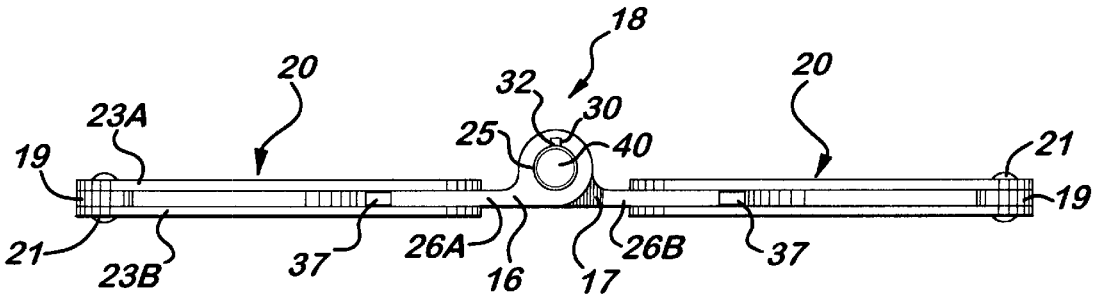
FIG. 2 is a side profile view of the HLSC of FIG. 1 in the locked opened (or rigid) position.

Turning now to the drawings, FIGS. 1 and 2 illustrate a hinge lock safety cuff 18 using the lockable hinge of the present invention in the open and locked position. The invention employs conventional (swing-through) handcuff wrist bracelets 20 which are adapted to be connected with hinges. Suitable bracelets are manufactured by Smith and Wesson and many other suppliers, and are disclosed in U.S. Pat. No. 5,205,142, which is incorporated herein by reference. As shown, the bracelets include a generally arcuate jaw member 27 having ratchet-like teeth 29 at one end and a second arcuate member 23 comprising two parallel components 23A and 23B. These two components are rotatably hinged together with pin or rivet 21 or the equivalent so that pin 21 passes through holes in the swivel ends (19) of members 23 and 27 and jaw member 27 is able to rotate between the components 23A and 23B of member 23. FIG. 2 shows portions of the open spaces (37) through which jaw member 23 rotates. Ratchet section 29 on jaw member 27 enters the base portion of member 23 to lock the cuffs by conventional means (not shown here). Suitable locking mechanisms are disclosed in U.S. Pat. No. 5,205,142 and many other sources. Keyhole 31 is provided for locking the cuffs by conventional key means. Slot 33 is preferably provided for double locking the cuff bracelets, as disclosed in U.S. Pat. No. 4,287,731, which is incorporated herein by reference. Such wrist bracelets can be similar to many models on the commercial market, including the Universal Handcuff and Hinged Handcuff made by Smith and Wesson, the Ultra Light Hinged Handcuff, Oversized Hinged Handcuff and A-550 Handcuff made by American and the Standard and Hinged handcuffs made by Peerless. Suitable cuff bracelets are also disclosed in U.S. Pat. No. 4,138,867, which is incorporated herein by reference.

Double hinge paw 22 and hinge platform 26A are components of a hinge assembly component 16, one solid piece of steel which fits together in intertwined manner with single hinge paw 24 by means of a single center hinge rod 40 (attached to hinge component 17, including hinge platform 26B). Hinge platforms 26A and 26B can be attached to the cuff bracelets by any suitable conventional means which is adapted to the commercial bracelets employed. Although these conventional attachment means are not shown here, the hidden ends of the hinge platforms which attach to the bracelet members can be shaped like those shown in FIG. 3 of U.S. Pat. No. 5,205,142. These hinge platforms can be mechanically fastened to the larger ends of the bracelet members 23 by spot-welding, pins, rivets or other suitable means (not shown). Hinge component 16 includes two hinge paws 22 which are bent or otherwise shaped to form cylindrical holes 25 which fit rotatably about center hinge rod 40. Similarly, single hinge paw 24 of hinge assembly component 17 also has a hole 25 (not shown here) which fits about pin 40 when the single hinge paw 24 is fitted between the twin hinge paws 22 of hinge component 16. The hinge components as well as the bracelet components can be formed by conventional industrial methods such as forging or stamping from various steels or other strong metal alloys.

It should be noted that the interconnected double hinge paw and single hinge paw shown here are but the simplest and most practical form for hinged connection of handcuff bracelets, and are shown here to demonstrate basic functions of the present invention. Although less practical, variations on the same theme could serve the same function, with possible advantages of strength and durability. A double hinge paw interconnecting with a triple paw or a triple paw interconnecting with a quadruple paw are possible combinations. The objective is to provide hinge paws and sections thereof which intertwine like the fingers of clasped hands, one hinge paw typically having one section more than the other.

Hinge platforms 26A and 26B are connected to the handcuff wrist bracelets 20 by conventional connecting means such as rivets, pins or welds commonly used in the manufacturing of handcuffs.

Figure 3:
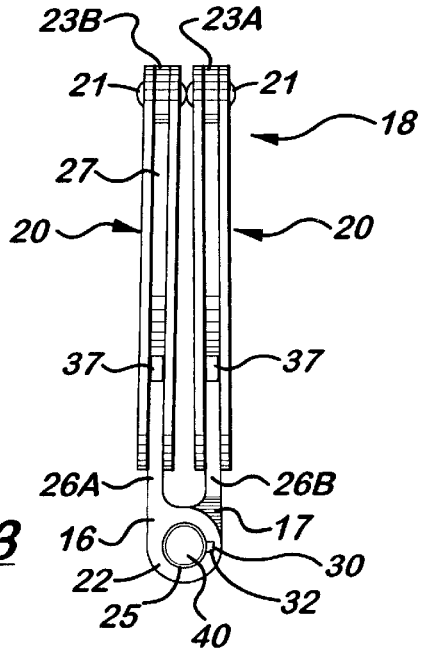
FIG. 3 is a side profile view of the HLSC in the folded "storage" position.
Figure 4:
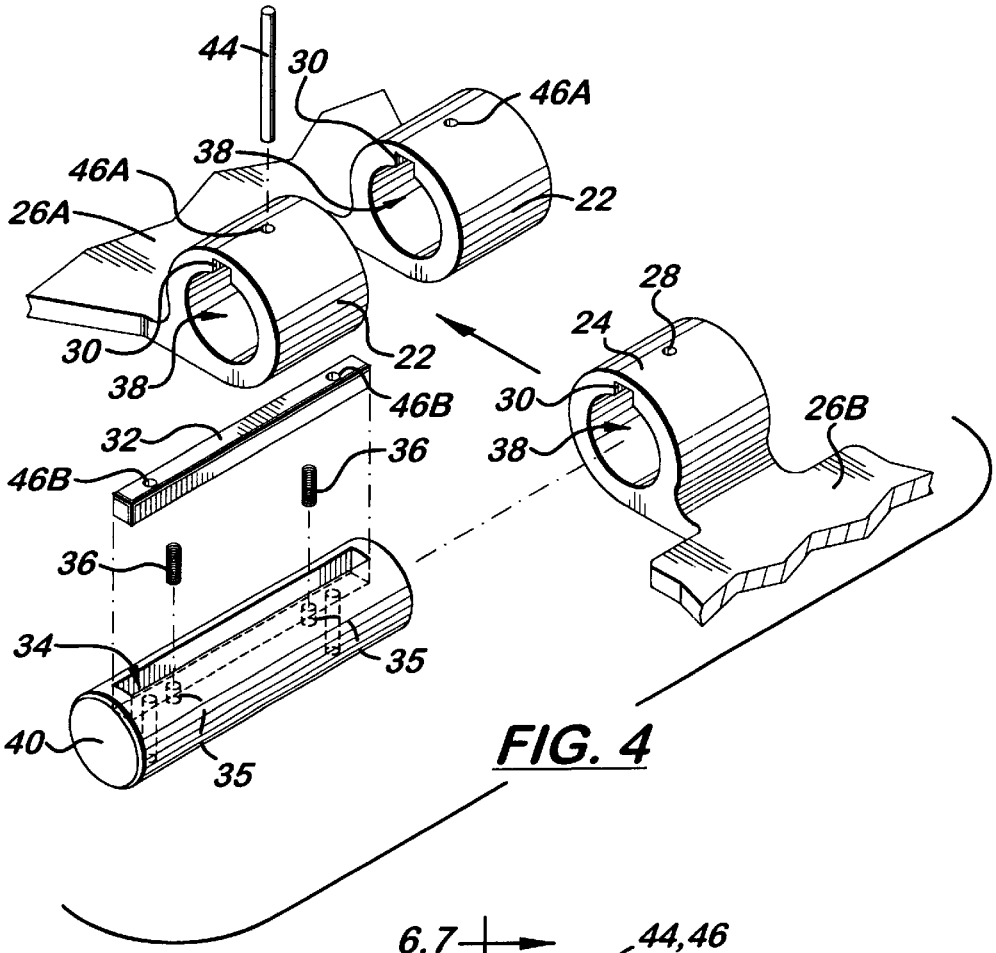
FIG. 4 is an exploded perspective view of the HLSC hinge and its internal components.
Figure 5:
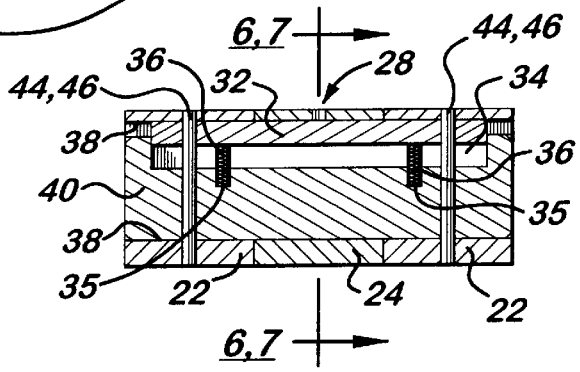
FIG. 5 is a longitudinal sectional view of the center hinge rod, detailing the position of the locking bar, locking bar pocket, internal springs, and the (2) fixed stabilizing pins.

Depression access hole 28 in single hinge paw 24 allows for the insertion of the backside of a common handcuff key or object of similar size and shape (i.e., about 2 mm in diameter and at least about 5 mm long) for the purpose of contacting locking bar 32 (shown in FIG. 4). Pressing down thus on locking bar 32 causes coil springs 36 to compress. (At least two coil springs 36, made of conventional spring steel, fit into holes 35 inside locking bar recess 34 and serve to keep locking bar 32 in position in locking grooves 30 in hinge paws 22 and 24. Compression of springs 36 allows locking bar 32 to be pushed out of locking grooves 30, allowing hinge paws 22 and 24 to be rotated about rod 40 so that the cuffs can be folded into the storage position, as shown in FIG. 3.) Locking grooves 30 include rectangular grooves (milled or cut into interior cylinder walls 38 of hinge paws 22 and 24) which act as a receptacle for locking bar 32 when all grooves in the hinge paws are aligned.

Figure 6:
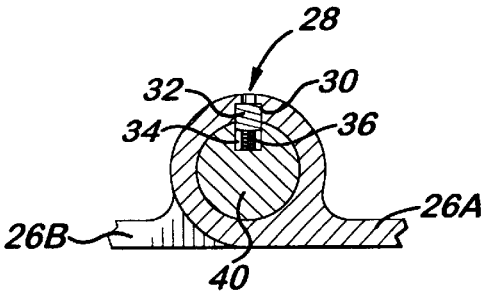
FIG. 6 is a cross sectional view of the center hinge rod demonstrating the locking bar pressed into the locking groove by the upward tension of the springs, with cuffs unfolded.
Figure 7:
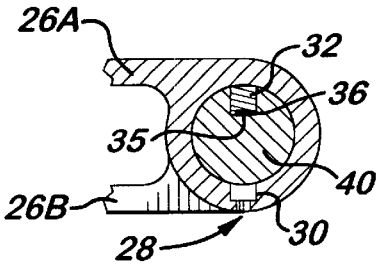
FIG. 7 is a cross sectional view demonstrating the locking bar in the depressed position and restrained by the inner cylinder walls of the hinge while cuffs are in the closed "storage" position.

Locking bar 32 should be sized and finished to slide easily into locking grooves 30 and provide a close fit for security when in place. This will normally result when bracelets 20 are aligned to form a single plane with hinge assembly components 16 and 17, as shown in FIGS. 1, 2 and 6. To engage locking bar 32 into locking grooves 30, it is necessary that the grooves 30 in all three (or more) paws be aligned. When the hinge is in the folded, storage position (FIG. 3), these locking grooves 30 are misaligned, which causes locking bar 32 to be restrained against the inner cylinder walls 38 of the single hinge paw 24 and double hinge paw 22, as shown in FIG. 7. Once the handcuffs are fully opened to a flat profile (i.e., with hinge assembly components 16 and 17 forming a single plane) as in FIGS. 1, 2, 4 and 6, the locking grooves 30 become aligned and the locking bar 32 is engaged. When the hinge is thus locked, it creates a rigid pair of handcuffs.

Figure 10:
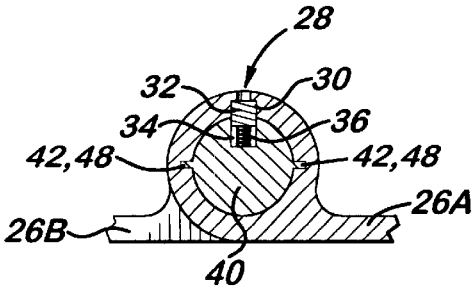
FIG. 10 is a variation of the sectional view of FIG. 6, demonstrating the locking bar pressed into the locking groove by the upward tension of the springs.
Figure 12:
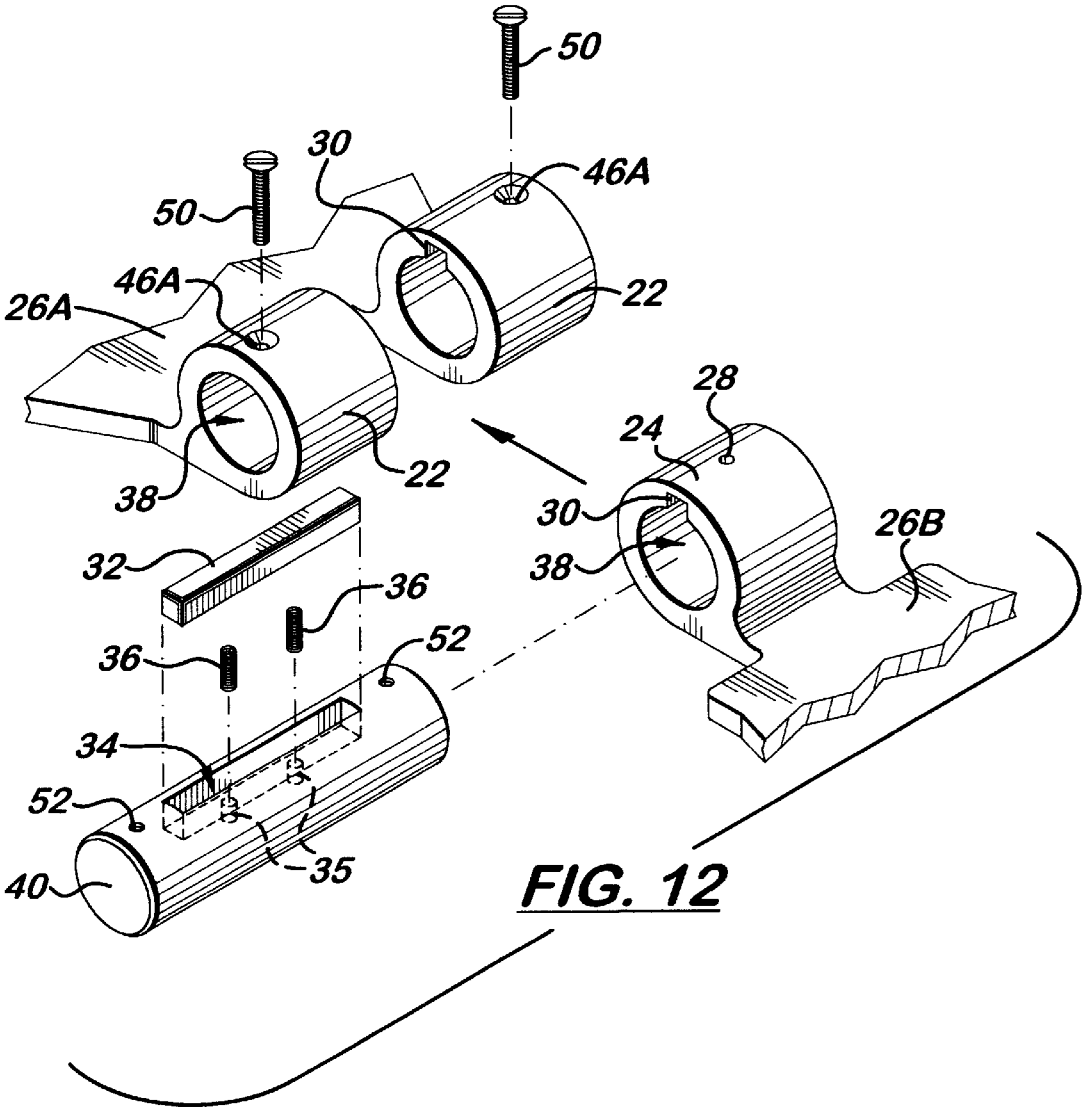
FIG. 12 is a variation of the exploded view of FIG. 4, illustrating alternative means of securing the assembled parts in place.

As shown in FIGS. 6 and 10, locking bar 32 sits in locking bar recess 34 in center hinge rod 40. Locking bar recess 34 is sized and finished to allow locking bar 32 to slide smoothly in and out through pressure from springs 36. Locking bar 32 is retained in recess 34 by the three sides and two ends of recess 34 and by the inner cylinder walls 38 of double hinge paw 22 and single hinge paw 24. The locking bar 32 is constantly pushed toward inner cylinder walls 38 by a tensioning mechanism such as coil springs 36 in FIGS. 4 and 8. This tension pushes locking bar 32 into locking grooves 30 in double hinge paw 22 and single hinge paw 24 when these locking grooves are aligned on all three hinge paws. Locking bar recess 34 retains coil springs 36 below the locking bar 32, with springs 36 seating in holes 35 at the bottom of recess 34. Locking bar 32 is of course formed of material having sufficent bulk and strength to prevent the locked cuffs from being forced out of alignment, preferably high grade steel or other suitable metal alloy. While locking grooves 30 are shown open at the outer surfaces of double hinge paw 22 for clarity, they can optionally be closed or obstructed to prevent access to locking bar 32 when the cuffs are unfolded, as shown in FIG. 12.

While coil springs 36 are shown for the tensioning mechanism, any suitable spring or other tensioning means could be used. For example, at least one leaf spring could be placed in locking bar recess 34 below locking bar 32, extending the full length of the locking bar recess. The exact size and form of the spring or other tensioning means are not critical, so long as sufficient pressure is exerted upon locking bar 32 to force it quickly and reliably into locking grooves 30 when they come into alignment, and the physical properties of the spring or other means permit this action to be dependably reproduced many times. Alternatively, or in addition to mechanical tensioning means, locking bar 32 could be drawn into locking groove 30 by a powerful magnet placed therein, provided metals of appropriate magnetic properties are used in fabrication of these parts.

Inner cylinder walls 38 are the bored out or machined internal portions of double hinge paw 22 and single hinge paw 24, and are suitably finished to allow smooth rotation of the parts and locking of the handcuffs when extended to the open position. Center hinge rod 40 is a solid rod of steel or other suitable metal or alloy, with locking bar recess 34 cut, machined or otherwise formed in the top lengthwise portion of its body. Locking bar recess 34 is positioned to hold locking bar 32 in place, as discussed above. Center hinge rod 40 holds double hinge paw 22 and single hinge paw 22 (and thus, the cuffs) together, and is large enough and strong enough to prevent any foreseeable bending or damage by a restrained prisoner. The use of such a single center hinge rod permits a compact handcuff assembly, whether in folded or extended positions.

FIG. 4 illustrates that double hinge paw 22 can be secured to center hinge rod 40 by suitable mechanical means, such as the two stabilizing pins 44 which pass through holes 46A and 46B in double hinge paw 22 and locking bar 32, respectively. Holes 46 (and pins 44) also continue through center hinge rod 40. This restraint causes center hinge rod 40, locking bar 32 and double hinge paw 24 to move together as one unit, thus allowing single hinge paw 24 to rotate freely around center hinge rod 40 until locking in the rigid extended position. Stabilizing pins 44 can be any suitable mechanical fastener such as frictional pins, rivets, bolts (e.g., headless Allen bolts) or the like.

Figure 8:
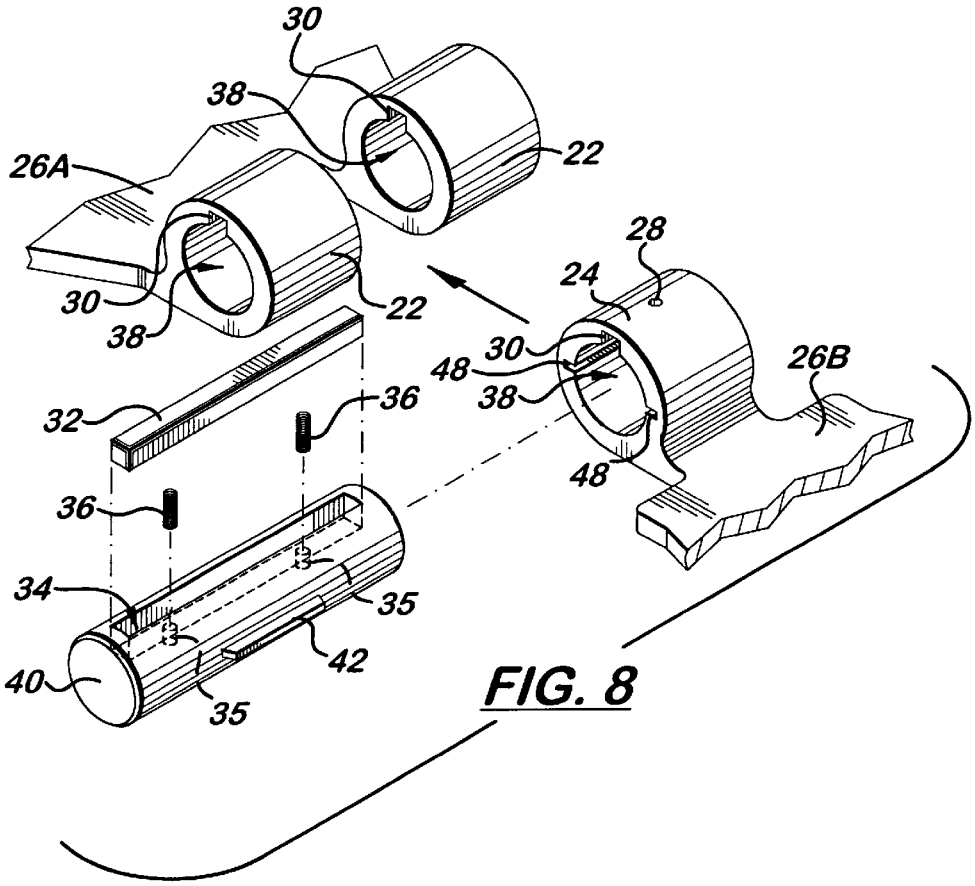
FIG. 8 is a variation of the exploded view of FIG. 4, adding a longitudinal pair of "wings" on the center hinge rod and accompanying hinge grooves to accommodate insertion of the wings. Removed are the (2) fixed stabilizing pins.

FIG. 8, a variation of FIG. 4, illustrates that center hinge rod 40 can also be secured within inner cylinder wall 38 of single hinge paw 24 by means such as the two solid hinge rod projections or wings 42 (on opposite sides of rod 40), which are slid into two corresponding hinge wing grooves 48 in the cylinder wall 38 of single hinge paw 24. This would cause center hinge rod 40 and single hinge paw 24 to rotate together as a unit, allowing double hinge paw 22 to rotate freely about center hinge rod 40 until the cuffs lock in the rigid extended position. Similar grooves 48 are also provided in cylinder walls 38 of at least one of the double hinge paws 22 to allow center hinge rod 40 with wings 42 to be slid into place during assembly. Thus, center hinge rod 40 can be affixed to either of the hinge paws 22 or 24 (or equivalent units) to form a unit, with the remaining hinge paw rotating freely about hinge rod 40. Hinge wings 42 can be formed by welding, forging and machining or other suitable means (e.g., molding or milling from one piece of steel) to form a component which is strongly attached to hinge rod 40, and is long enough to correspond to the width of single hinge paw 24 without extending beyond it.

Figure 9:
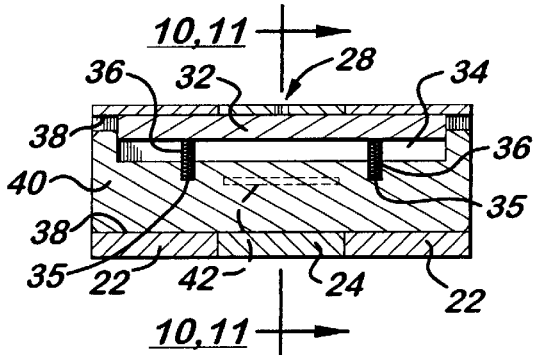
FIG. 9 is a variation of the sectional view of FIG. 5, detailing the position of the locking bar, locking bar recess, internal springs, and the position of the attached "wings".
Figure 11:
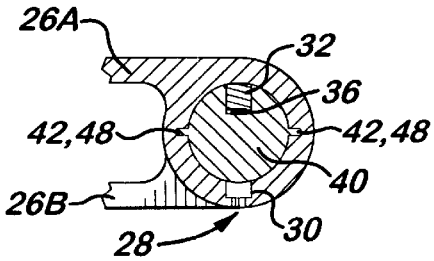
FIG. 11 is a variation of the sectional view of FIG. 7, demonstrating the locking bar in the depressed position and restrained by the inner cylinder walls of the hinge while cuffs are in the closed "storage" position.

The placement of these components is shown in more detail in FIGS. 9, 10 and 11. It is apparent that upon unfolding the cuffs so as to align all locking bar grooves 30, springs 36 or other tensioning means will force locking bar 32 into grooves 30. Since locking bar 32 also remains partially within locking bar recess 34 in center hinge bar 40, the hinge paws (and thus the cuffs) will be prevented from rotation or other movement until locking bar 32 is depressed sufficiently via the application of force through hole 28 in single hinge paw 24 (or other central equivalent hinge paw) to unseat locking bar 32. Since the cuffs automatically lock into the rigid unfolded position when unfolded sufficiently to align grooves 30, they can be easily placed in this position during or after application of the cuffs to a subject.

In operation, the cuffs are closed and folded together via the hinge for storage or contained in a suitable carrying case which can be kept on an officer's belt or other convenient location. The single hinge rod construction permits a very compact folded assembly. When a prisoner or suspect is to be restrained, the cuffs are generally unfolded and opened. It may be necessary to unlock each cuff to open same. With the subject's hands in position, a cuff is applied to at least one hand and locked automatically. The remaining cuff is then applied to the subject's other hand, or to a stationary object if desired. The cuffs can then be double-locked if desired. When the cuffs are fully unfolded into the locked or "rigid" position, the prisoner will be unable to alter their positions. While the rigid form of the cuffs thus applied may pose a hazard when the subject is placed in certain positions or falls, this may serve as a deterrent to prevent disruptive behavior. When the subject is restrained with the cuffs in locked position, significant leverage is available through the hinge of the cuffs to guide the subject in his actions, by force if necessary.

Figure 13:
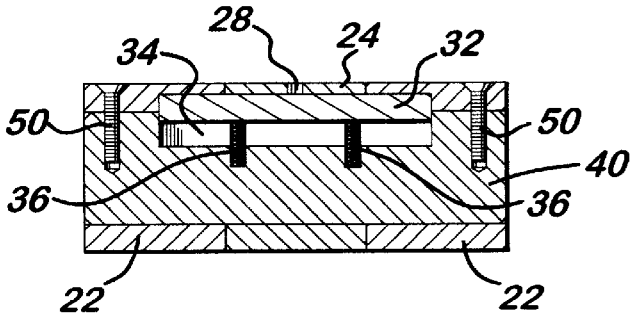
FIG. 13 is a longitudinal sectional view of the hinge of FIG. 12.

FIGS. 12 and 13 illustrate an embodiment in which machine screws 50 are inserted 20 through holes 46A in double hinge paws 22 and screwed into threaded holes 52 in center hinge rod 40 to secure hinge paws 22 to rod 40. In comparison to FIG. 4, locking grooves 30 can be closed as shown in FIG. 12, for increased security.

While the lockable hinge of the present invention has been discussed above and illustrated for a preferred embodiment of hinged, lockable handcuffs, the hinge itself can be employed in a wide variety of portable tools; and the like to provide for compact storage or carrying. For example, the handle and business end of tools such as shovels, paddles, chopping or cutting tools can be joined with the lockable hinge so that they can be folded for storage, but extended and locked securely in position for use. For example, a folding camp shovel could have the shovel blade attached to the handle by the lockable hinge. Similarly, the blades of various chopping or cutting tools can be attached to their handles by the hinge, which locks the blades into working position when unfolded. As an alternative to simply folding such blades back upon a handle (such as a camp shovel and handle), handles of wood or other suitable materials can be provided with a recess which accommodates tools such as knife or saw blades when folded for storage. In addition, the handles themselves, or other suitable implements such as fishing rods, tent poles, gun cleaning rods, batons and the like, can be joined by at least one such locking hinge to permit more compact folded positions for storage. The lockable hinges can also be used to attach handles to wheeled devices such as toy scooters, luggage carriers, grocery carts and the like, again to provide for compact storage and convenience.

Various changes and modifications to the presently preferred embodiments will be apparent to those skilled in the art. Such changes and modifications may be made without departing from the spirit and scope of the present invention and without diminishing its attendant advantages. Therefore, the appended claims are intended to cover such changes and modifications, and are the sole limits on the scope of the invention.

I claim:

1. A lockable hinge, comprising:

a center hinge rod;

two hinge assembly components, each comprising a hinge platform and at least one hinge paw attached thereto, said hinge paws each forming a cylindrical opening which is rotationally attached to said center hinge rod so that said hinge paws are adjacent to each other and can rotate in opposite directions;

retaining means to keep said hinge assembly components in position, with said cylindrical openings of said hinge paws rotationally attached to said hinge rod; and mechanical means in said center hinge rod for automatically locking both of said hinge paws to said center hinge rod when said hinge assembly components are rotated so that they form a single plane.

2. The lockable hinge of claim 1 wherein a first hinge component comprises at least one hinge paw, the second hinge component comprises at least one more hinge paw than the first, said hinge paws are rotationally attached to said rod so that they are mutually intertwined, and one set of said hinge paws is mechanically attached to said center hinge rod to prevent rotation thereon.

3. The lockable hinge of claim 2 wherein at least one of said hinge paws is mechanically attached to said center hinge rod by a mechanical fastener extending laterally through said hinge paw and said rod inside the cylindrical opening of said hinge paw.

4. The lockable hinge of claim 2 wherein at least one of said hinge paws is mechanically attached to said center hinge rod by at least one projection from said rod which interacts with at least one longitudinal groove in the inner cylinder wall of the opening in said hinge paw.

5. The lockable hinge of claim 1 which further comprises means for unlocking said hinge paws and rotating said hinge components to fold said hinge.

6. The lockable hinge of claim 1 wherein said means for locking said hinge paws to said center hinge rod comprise at least one longitudinal locking groove within the inner cylinder walls of each said hinge paw, positioned such that all of said grooves are in alignment when said hinge is in the fully extended position, and a locking bar adapted to enter all of said grooves when thus aligned to lock them in position upon said center hinge rod, wherein said locking bar is positioned in a longitudinal recess upon the surface of said center hinge rod and is fitted with tensioning means to press a portion of said locking bar into said locking grooves when they reach alignment, with a portion of said locking bar remaining within said longitudinal recess to lock said hinge paws to said rod.

7. The lockable hinge of claim 6, further comprising external access means for exerting inward pressure upon said locking rod to force it from said locking grooves in said inner cylinder walls into said longitudinal recess in said center hinge rod to unlock said hinge paws and allow rotation thereof about said center hinge rod.

8. A set of foldable handcuffs comprising two handcuff wrist bracelets, each attached to a hinge platform of said hinge assembly components of claim 1.

9. The foldable handcuffs of claim 8 wherein each of said bracelets can be separately opened and locked when closed.

10. The foldable handcuffs of claim 8 wherein said bracelets and said hinge assembly components form a single plane when said handcuffs are in the extended and locked position.

11. The foldable handcuffs of claim 8 which fold for storage with said bracelets adjacent to each other and said hinge assembly components parallel to each other.

12. A set of foldable handcuffs comprising two handcuff wrist bracelets, each attached to a hinge platform of said hinge assembly components of claim 2.

13. A set of foldable handcuffs comprising two handcuff wrist bracelets, each attached to a hinge platform of said hinge assembly components of claim 3.

14. A set of foldable handcuffs comprising two handcuff wrist brcelets, each attached to a hinge platform of said hinge assembly components of claim 6.

15. A set of foldable handcuffs comprising two handcuff wrist bracelets, each attached to a hinge platform of said hinge assembly components of claim 7.

16. A hinged, foldable pair of handcuffs comprising two separate handcuff wrist bracelets connected by a lockable hinge, said hinge comprising:

a center hinge rod and two hinge assembly components rigidly attached to said bracelets, each comprising a hinge platform connected to one of said bracelets, a first hinge component comprising a double hinge paw and a second hinge component comprising a single hinge paw, wherein each hinge paw contains a cylindrical opening therein and the hinge components are arranged with said double hinge paw and said single hinge paw intertwined, with the cylindrical openings therein mounted upon said center hinge rod;

mechanical means for retaining said hinge paws in position upon said hinge rod; and mechanical means in said center hinge rod for automatically locking both of said hinge paws in position upon said center hinge rod when said hinge components are rotated into the same plane, thus locking said handcuffs into a rigid extended position.

17. The handcuffs of claim 16 wherein said double hinge paw is retained upon said hinge rod by at least one mechanical fastener which passes laterally through both walls of said hinge paw and the center hinge rod occupying the cylindrical opening therein.

18. The handcuffs of claim 16 wherein said single hinge paw is retained upon said center hinge rod by at least one longitudinal projection on said hinge rod which is adapted to fit into a longitudinal groove in the inner wall of said cylindrical opening in said hinge paw to prevent rotation of said hinge paw about said hinge rod.

19. The handcuffs of claim 16 wherein said means for locking said hinge paws in place comprise:

longitudinal locking grooves in each of said hinge paws so arranged as to align into a single groove when said hinge assembly components are rotated to occupy the same plane;

a locking bar contained in a longitudinal recess in the surface of said center hinge rod, fitted with spring tensioning means to press said locking bar outward unless restrained, and adapted to be automatically pressed into said locking grooves when said grooves are aligned, with a portion of said locking bar remaining in said recess in said hinge rod to prevent rotation of said hinge paws relative to said rod.

20. The handcuffs of claim 19 wherein at least one access means is provided in at least one of said hinge paws for exerting external pressure upon said locking bar to press it inward and remove it from said locking grooves and thereby to unlock said hinge.

21. The lockable hinge of claim 7 wherein said external access means comprise a small hole positioned in one of said hinge paws to allow the entry of a pin to exert pressure upon said locking rod.

22. The set of hinged handcuffs of claim 15, wherein said external access means comprise a small hole positioned in one of said hinge paws to allow the entry of a pin no larger than the backside of a common handcuff key to exert pressure upon said locking rod.

23. The handcuffs of claim 20 wherein said access means comprise at least one small hole positioned in one of said hinge paws to allow the entry of a pin no larger than the backside of a common handcuff key to exert pressure upon said locking rod.

* * * * *